US009449586B2

(12) United States Patent
Yamamoto et al.

(10) Patent No.: US 9,449,586 B2
(45) Date of Patent: Sep. 20, 2016

(54) KEYBOARD DEVICE

(71) Applicant: Yamaha Corporation, Hamamatsu-shi, Shizuoka-ken (JP)

(72) Inventors: Shin Yamamoto, Hamamatsu (JP); Yu Yoshizaki, Hamamatsu (JP); Mitsuru Kitajima, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/880,116

(22) Filed: Oct. 9, 2015

(65) Prior Publication Data

US 2016/0104464 A1 Apr. 14, 2016

(30) Foreign Application Priority Data

Oct. 9, 2014 (JP) ..... 2014-208179

(51) Int. Cl.
*G10C 3/12* (2006.01)

(52) U.S. Cl.
CPC ..... *G10C 3/12* (2013.01)

(58) Field of Classification Search
CPC ..... G10C 3/12
USPC ..... 84/433
See application file for complete search history.

(56) References Cited

U.S. PATENT DOCUMENTS 4,914,999 A * 4/1990 Masubuchi ..... G10C 3/12 200/5 A
6,133,517 A * 10/2000 Masubuchi ..... G10H 1/344 84/423 R
6,156,963 A * 12/2000 Masubuchi ..... G10H 1/344 84/423 R
7,427,723 B2 * 9/2008 Watanabe ..... G10H 1/344 200/343
8,110,732 B2 * 2/2012 Shimoda ..... G10C 3/12 84/423 R
8,350,140 B2 * 1/2013 Taniguchi ..... G10H 1/346 84/423 R
8,440,896 B2 * 5/2013 Hoshino ..... G10C 3/12 84/423 R

FOREIGN PATENT DOCUMENTS

JP H03-100893 U 10/1991

* cited by examiner

*Primary Examiner* — Jianchun Qin
(74) *Attorney, Agent, or Firm* — Morrison & Foerster LLP

(57) ABSTRACT

A keyboard device includes: key units each including a coupler and white or block keys coupled to the coupler at their rear ends; and a key frame assembled to the key frame and supporting the couplers stacked on each other. The coupler of one of the key units is provided with a hook having an engaging portion. The coupler of each of at least one other key unit has a through hole at a position corresponding to the hook. The key frame has a through hole at a position corresponding to the hook. The couplers of the key units are secured on the key frame using the engaging portion in a state in which the hook extends through the through hole of the coupler of each of the at least one other key unit and the through hole of the key frame.

12 Claims, 8 Drawing Sheets

KEYBOARD DEVICE

CROSS REFERENCE TO RELATED APPLICATION

The present application claims priority from Japanese Patent Application No. 2014-208179, which was filed on Oct. 9, 2014, the disclosure of which is herein incorporated by reference in its entirety.

BACKGROUND

1. Technical Field

The following disclosure relates to a keyboard device including: a plurality of key units each having a plurality of white keys or a plurality of black keys; and a key frame to which the plurality of key units are assembled.

2. Description of the Related Art

There is conventionally known a keyboard device including: a plurality of key units each having a plurality of white keys or a plurality of black keys; and a coupler elongated so as to extend in a key arrangement direction in which the white keys and the black keys are arranged. Rear ends of the white keys or the black keys are coupled to the coupler, and the white keys or the black keys and the coupler are formed in one piece. The key units are assembled to the key frame such that the couplers of the respective key units are stacked on the key frame. In the state in which the key units are assembled to the key frame, the heights of the couplers respectively corresponding to the key units are different from each other. In such a keyboard device, for example, as disclosed in Patent Document 1 (Japanese Unexamined Utility Model Application Publication No. 3-100893), groups of the white keys and the black keys in the key arrangement direction differ in position from each other in accordance with the key units, and rear end surfaces of the respective couplers are respectively provided with hooks each extending from the rear end surface rearward and downward and having an engaging portion extending frontward at a lower end portion of the hook. The couplers of the respective key units are stacked on an upper surface of a rear end portion of the key frame, and the engaging portion of the hook of each key unit is engaged with a lower surface of the key frame to assemble the key units onto the key frame.

SUMMARY

In the conventional keyboard device, however, the hook extends rearward from the rear end surface of the coupler, resulting in increase in length of a rear end portion of each key unit in the front and rear direction, leading to increase in dimension of the key unit in the front and rear direction, unfortunately.

Accordingly, an aspect of the disclosure relates to a keyboard device including a plurality of key units having a small dimension in a front and rear direction.

In one aspect of the disclosure, a keyboard device includes: a plurality of key units each including (i) a plurality of white keys or a plurality of black keys and (ii) a coupler elongated so as to extend in a key arrangement direction in which the plurality of white keys and the plurality of black keys are arranged, rear ends of the plurality of white keys or the plurality of black keys being coupled to the coupler, the plurality of white keys or the plurality of black keys and the coupler being coupled in one unit; and a key frame supporting a plurality of couplers of the plurality of key units. The plurality of couplers are stacked on each other, the plurality of key units being assembled to the key frame. The coupler of one key unit of the plurality of key units is provided with a hook extending in an up and down direction. The hook has an engaging portion at an end portion of the hook. The hook is configured to fit within a length of the coupler of the one key unit. The plurality of key units include at least one other key unit other than the one key unit. The coupler of each of the at least one other key unit has a through hole formed through the coupler in the up and down direction at a position corresponding to the hook. The key frame has a through hole formed through the key frame in the up and down direction at a position corresponding to the hook. The plurality of couplers of the plurality of key units are secured on the key frame using the engaging portion in a state in which the hook extends through the through hole of the coupler of each of the at least one other key unit and the through hole of the key frame.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Figure 1:
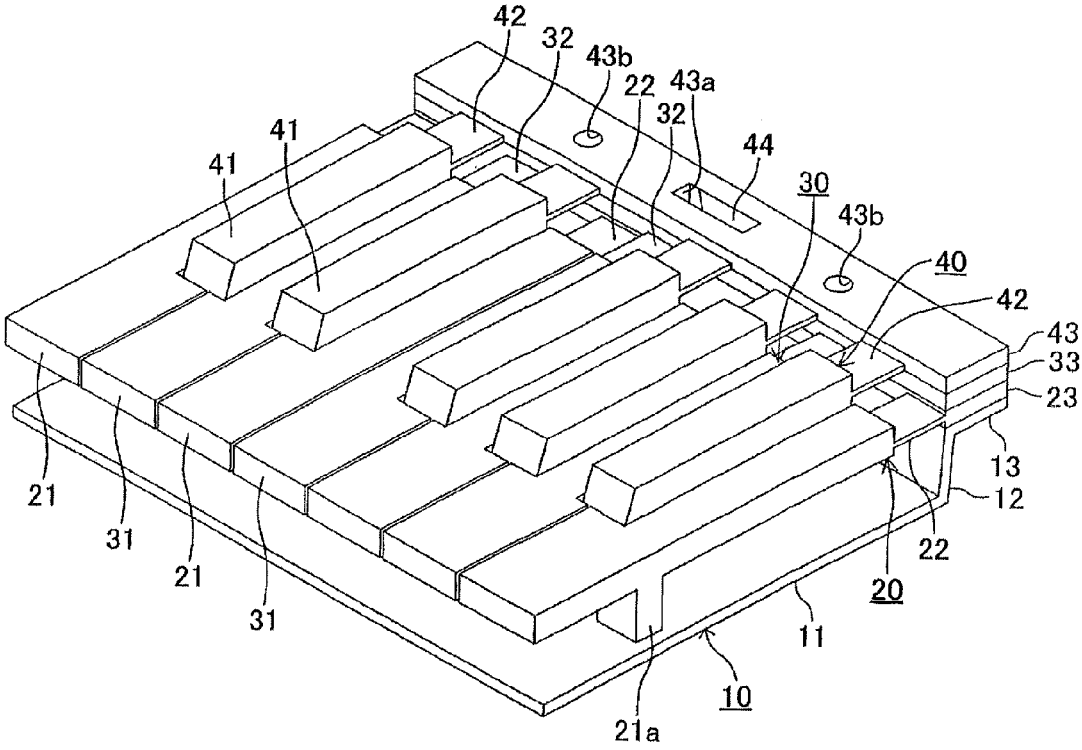
FIG. 1 is a perspective view generally illustrating a keyboard device including keys corresponding to one octave, according to one embodiment.
Figure 2:
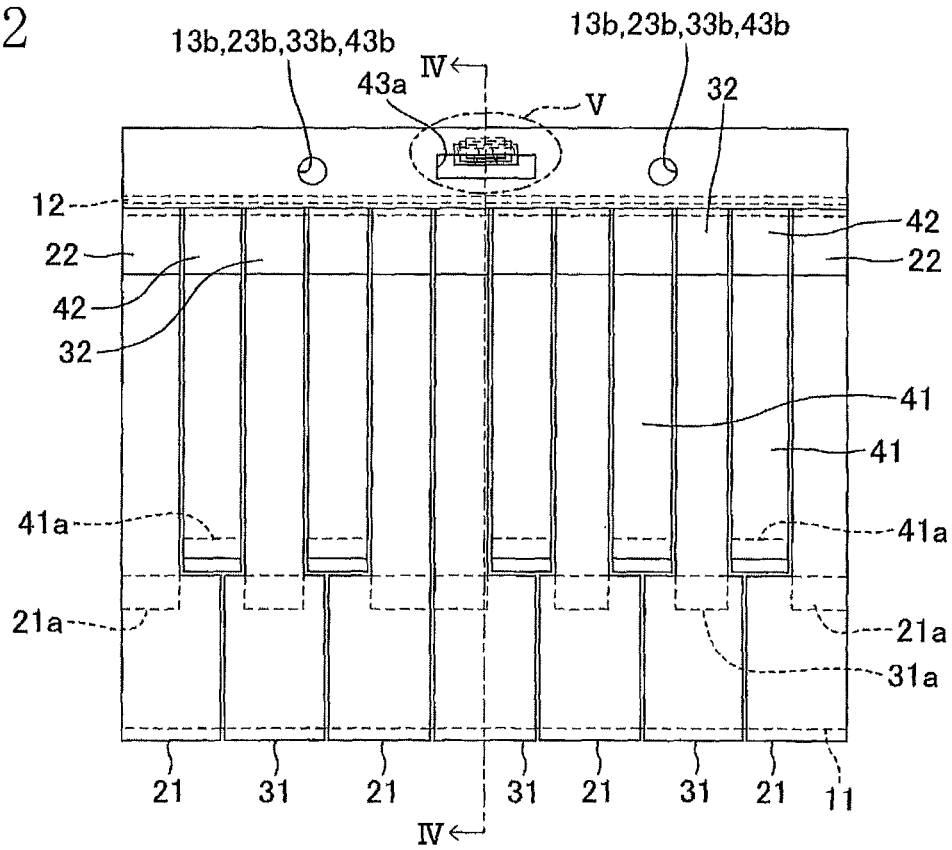
FIG. 2 is a plan view of the keyboard device in FIG. 1.
Figure 3:
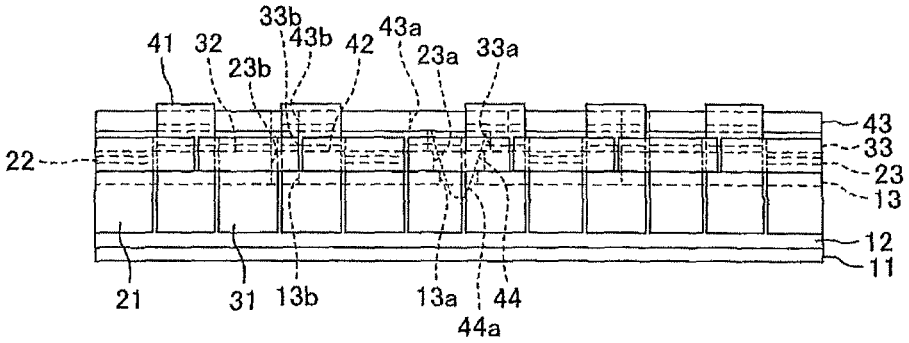
FIG. 3 is a front elevational view of the keyboard device in FIG. 1.
Figure 4:
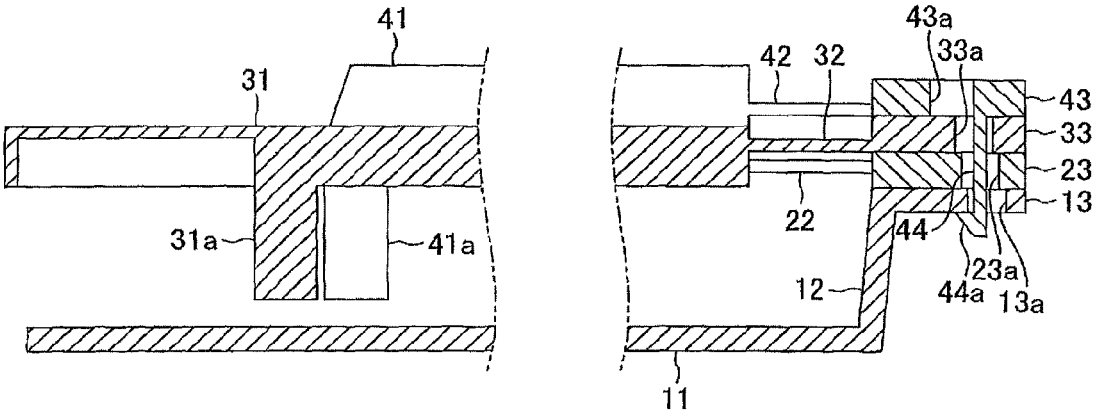
FIG. 4 is an enlarged view in cross section taken along line IV-IV in FIG. 2.
Figure 5:
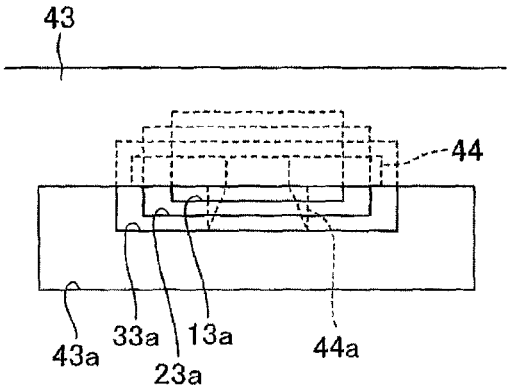
FIG. 5 is an enlarged view of the area V in FIG. 2.

Hereinafter, there will be described one embodiment by reference to the drawings. FIG. 1 is a perspective view generally illustrating a keyboard device including keys corresponding to one octave, according to one embodiment. FIG. 2 is a plan view illustrating the keyboard device. FIG. 3 is a front elevational view illustrating the keyboard device. FIG. 4 is an enlarged view in cross section taken along line IV-IV in FIG. 2. FIG. 5 is an enlarged view of the area V in FIG. 2. In the following description, a player side (the lower left side in FIG. 1 and the lower side in FIG. 2) is defined as a front side of the keyboard device, and an opposite side (the upper right side in FIG. 1 and the upper side in FIG. 2) of the keyboard device from the player side is defined as a rear side of the keyboard device. The right and left direction with respect to the player (the direction directed from the upper left side toward the lower right side in FIG. 1, and the right and left direction in FIG. 2) is defined as the right and left direction with respect to the keyboard device. It is noted that the following explanation will be provided for construction corresponding one octave for simplicity.

The keyboard device includes a keyboard and a key frame 10 disposed under the keyboard and fixed in a keyboard instrument. The key frame 10 includes a lower board 11, a standing wall 12, and an upper board 13 each having a planar plate shape. The lower board 11 is disposed in front of the standing wall 12 and the upper board 13 so as to extend horizontally in the right and left direction and the front and rear direction. The standing wall 12 is provided on a rear end of the lower board 11 so as to extend upward. The upper board 13 are elongated in the right and left direction and horizontally extends rearward from an upper end of the standing wall 12 by a predetermined distance. These lower board 11, the standing wall 12, and the upper board 13 are formed in one piece and of a material such as metal or resin. The upper board 13 has a through hole 13*a* having a rectangular parallelepiped shape. The through hole 13*a* extends through the upper board 13 in the up and down direction such that front and rear inner surfaces of the through hole 13*a* are parallel to respective front and rear surfaces of the upper board 13. Rear end portions of first through third key units 20, 30, 40 are disposed on the upper board 13, and each of the first through third key units 20, 30, 40 is formed of resin in one piece. Round screw holes 13*b* are formed in the upper board 13 respectively on opposite sides of the through hole 13*a*. Each of the screw holes 13*b* has a female thread formed on its inner circumferential surface and extends through the upper board 13 in the up and down direction. A screw, not shown, is to be screwed into the screw hole 13*b* to firmly secure the first through third key units 20, 30, 40. This screw hole 13*b* may be replaced with a circular cylindrical hole not having a female thread formed on its inner surface. In this construction, a self-tapping screw may be screwed into the circular cylindrical hole to firmly secure the first through third key units 20, 30, 40 to the upper board 13.

Figure 6A:
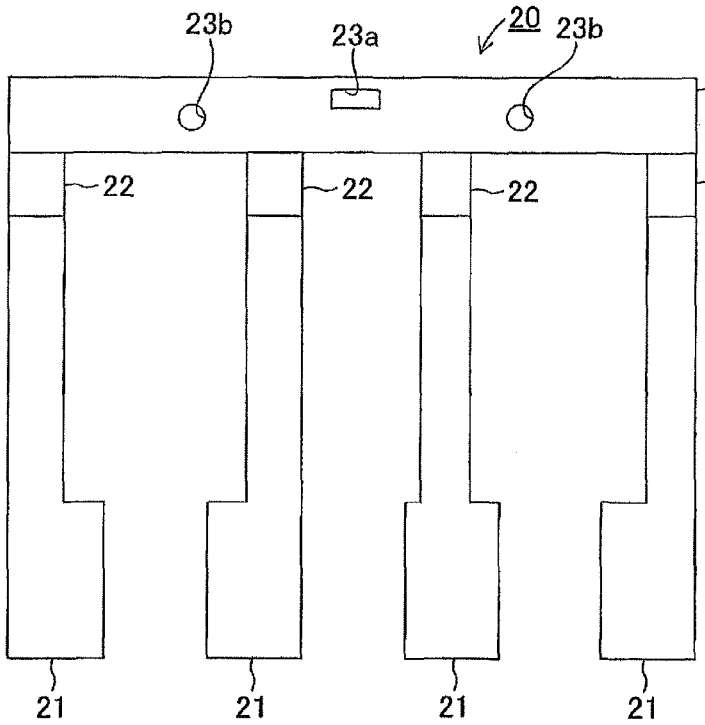
FIG. 6A is a plan view of the first key unit in FIGS. 1 through 4.
Figure 6C:
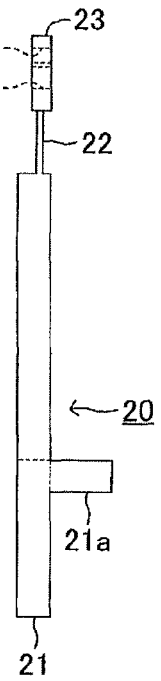
FIG. 6C is a side view of the first key unit.
Figure 6B:
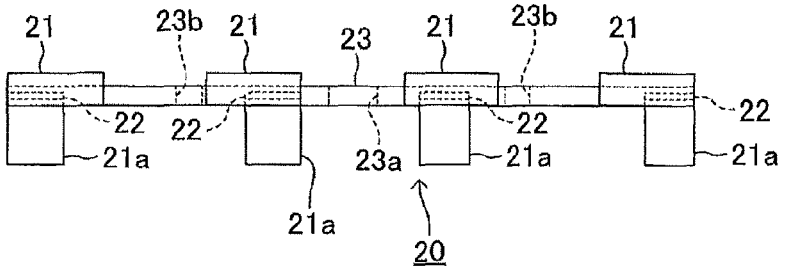
FIG. 6B is a front elevational view of the first key unit.
Figure 10:
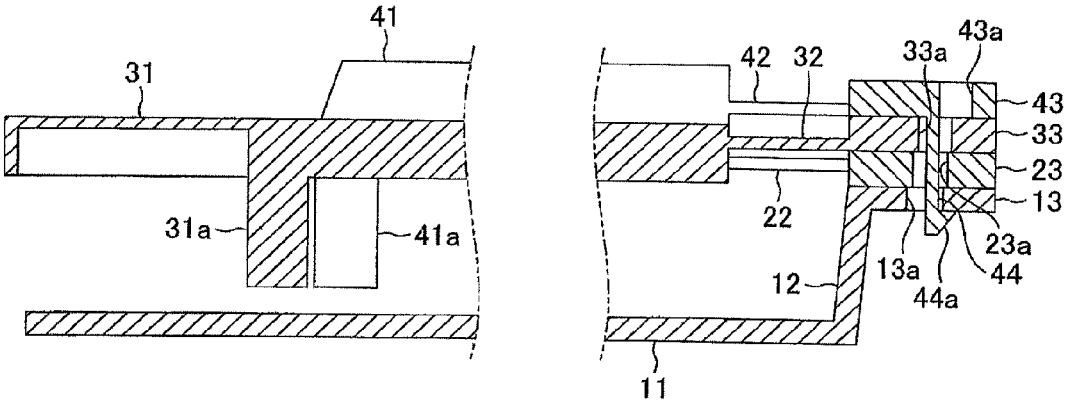
FIG. 10 is a cross sectional view illustrating a keyboard device according to a modification of the embodiment and corresponding to FIG. 4.
Figure 11:
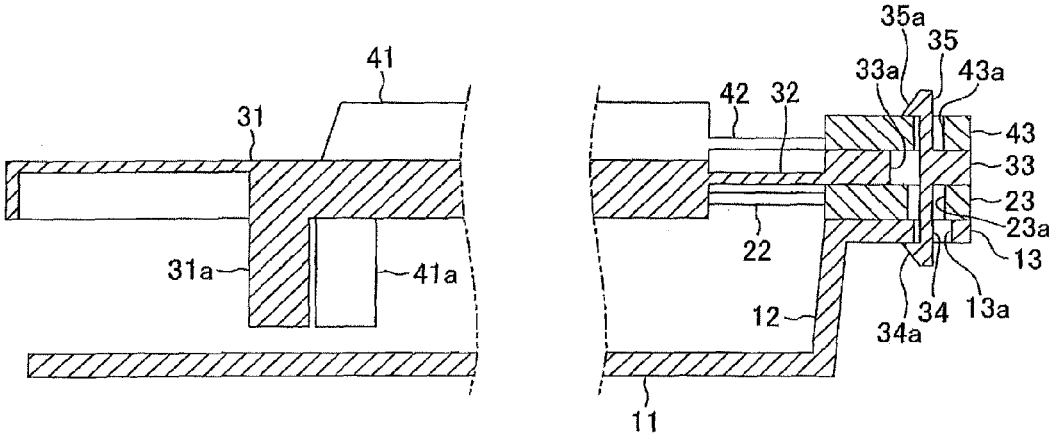
FIG. 11 is a cross sectional view illustrating a keyboard device according to another modification of the embodiment and corresponding to FIG. 4.

The first key unit 20 will be explained first with reference to FIGS. 6A-6C. FIG. 6A is a plan view of the first key unit 20, FIG. 6B is a front elevational view thereof, and FIG. 6C is a side view thereof. The first key unit 20 includes four white keys 21 not next to each other and respectively corresponding to notes C, E, and B. Each of the white keys 21 is constituted by an upper plate, a front wall, side walls, and a rear wall, which define a space opening downward and having a rectangular shape in cross section. It is noted that broken lines indicating inner surfaces of the upper plate, the front wall, the side walls, and the rear wall with consideration of their thicknesses are omitted in the figures other than FIGS. 4, 10, and 11 although the thicknesses are illustrated in FIGS. 4, 10, and 11. The upper plate and the side walls have one or two inside corner portions each for arrangement of a corresponding one of black keys 41. Each of the white keys 21 is provided with a protrusion 21*a* which protrudes from a lower surface of the white key 21 at a position slightly in front of the center of the lower surface in the front and rear direction. Specifically, the protrusion 21*a* protrudes downward in the vertical direction such that a lower end surface of the protrusion 21*a* faces an upper surface of the lower board 11 of the key frame 10. When the white key 21 is depressed, the protrusion 21*a* is brought into contact with a guide member, not shown, provided on the upper surface of the lower board 11, to guide downward movement of the white key 21.

The rear walls of the respective four white keys 21 are connected to a coupler 23 via respective hinges 22. The hinges 22 and the coupler 23 are molded integrally with the white keys 21. Each of the hinges 22 is equal to a rear end portion of a corresponding one of the white keys 21 in width in the right and left direction and has a rectangular and planar plate shape with a small thickness so as to facilitate its elastic deformation in the up and down direction. The hinge 22 extends rearward from its front end connected to the rear wall of the white key 21. It is noted that the width of the hinge 22 in the right and left direction may not be equal to that of the rear end portion of the white key 21 and may be smaller than that of the rear end portion of the white key 21 and may be larger than that of the rear end portion of the white key 21 as long as the hinge 22 does not overlap a next (right or left) one of respective hinges 32, 42 of white keys 31 and the black keys 41 which will be described below. This feature applies to the respective hinges 32, 42 of the white keys 31 and the black keys 41. A lower surface of the hinge 22 is located slightly above a lower end of the rear wall of the white key 21, while an upper surface of the hinge 22 is located below an upper end of the rear wall of the white key 21. When the white key 21 is depressed, the hinge 22 is elastically deformed to allow downward movement of a front end portion of the white key 21. When the white key 21 is released, the elastic force of the hinge 22 and a return force of another component, not shown, (e.g., a spring component of a contact rubber) raise the front end portion of the white key 21 to return the white key 21 to a normal position.

The coupler 23 having a rectangular shape in elevational cross section is elongated in the right and left direction. A rear end of each hinge 22 is connected to a front surface of the coupler 23. The coupler 23 has a relatively large thickness so as to make its deformation difficult, and the thickness of the coupler 23 in the up and down direction is larger than that of the hinge 22 in the up and down direction. The length of the coupler 23 in the front and rear direction is equal to that of the upper board 13 of the key frame 10 in the front and rear direction. A lower surface of the coupler 23 is located at a height equal to that of the lower surface of the white key 21 and located below the lower surface of the hinge 22. An upper surface of the coupler 23 is located below an upper surface of the white key 21 and located slightly above the upper surface of the hinge 22. The coupler 23 has a through hole 23*a* having a rectangular parallelepiped shape substantially at a center of the coupler 23 in the right and left direction in the present embodiment. The through hole 23*a* extends through the coupler 23 in the up and down direction such that front and rear inner surfaces of the through hole 23*a* are parallel to respective front and rear surfaces of the coupler 23. The coupler 23 has round through holes 23*b* at positions corresponding to the respective screw holes 13*b*. Each of the through holes 23*b* extends through the coupler 23 in the up and down direction, and the above-described screw, not shown, is to be inserted through the through hole 23*b*. It is noted that dimensions of the through hole 23*a* and a vertical position of the first key unit 20 assembled to the key frame 10 will be described later in detail.

Figure 7A:
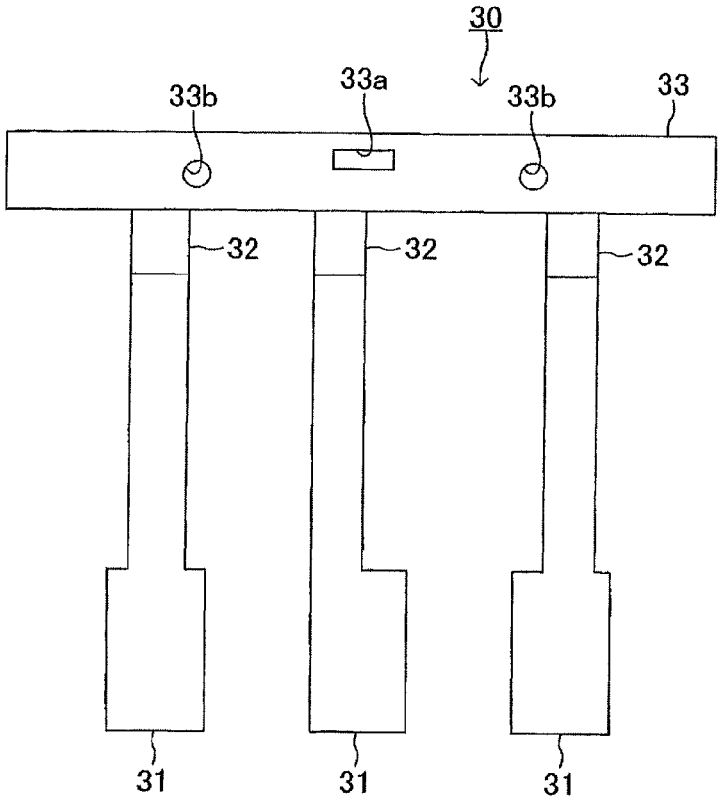
FIG. 7A is a plan view of the second key unit in FIGS. 1 through 4.
Figure 7C:
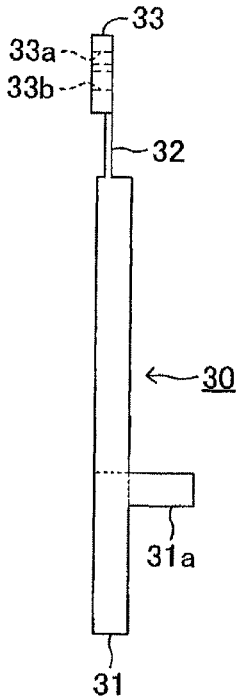
FIG. 7C is a side view of the second key unit.
Figure 7B:
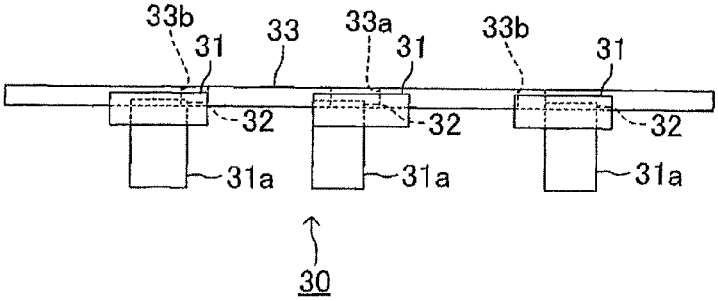
FIG. 7B is a front elevational view of the second key unit.

There will be next explained the second key unit 30 with reference to FIGS. 7A-7C. FIG. 7A is a plan view of the second key unit 30, FIG. 7B is a front elevational view thereof, and FIG. 7C is a side view thereof. The second key unit 30 includes three white keys 31 not next to each other and respectively corresponding to notes D, F, and A. Each of the white keys 31 is also constituted by an upper plate, a front wall, side walls, and a rear wall, which define a space opening downward and having a rectangular shape in cross section. Each of the white keys 31 is equal to each white key 21 in height and length in the front and rear direction. However, the white key 31 and the white key 21 are different from each other in inside corner portion or portions each provided on the upper plate and the side walls for arrangement of a corresponding one of black keys 41. A lower surface of the white key 31 is provided with a protrusion 31*a* having the same shape and function as those of the protrusion 21*a* provided on the white key 21.

The rear walls of the respective three white keys 31 are connected to a coupler 33 via respective hinges 32. Each of the hinges 32 and the coupler 33 are similar in construction to the hinge 22 and the coupler 23, respectively. The coupler 33 has a through hole 33*a* having a rectangular parallelepiped shape. The through hole 33*a* extends through the coupler 33 in the up and down direction such that front and rear inner surfaces of the through hole 33*a* are parallel to respective front and rear surfaces of the coupler 33. Also, the coupler 33 has through holes 33*b* similar to the through hole 23*b*. The thickness of the hinge 32 in the up and down direction is equal to that of the hinge 22. Likewise, the thickness of the coupler 33 in the up and down direction is equal to that of the coupler 23. In the case of this construction, a lower surface of the hinge 32 is located above the lower surface of the white key 31, and an upper surface of the hinge 32 is located slightly below an upper surface of the white key 31. A lower surface of the coupler 33 is located above the lower surface of the white key 31 and at a height equal to that of the lower surface of the hinge 32. An upper surface of the coupler 33 is located slightly above the upper surface of the white key 31 and above the upper surface of the hinge 32. It is noted that dimensions of the through hole 33*a* and a vertical position of the second key unit 30 assembled to the key frame 10 will be described later in detail.

Figure 8A:
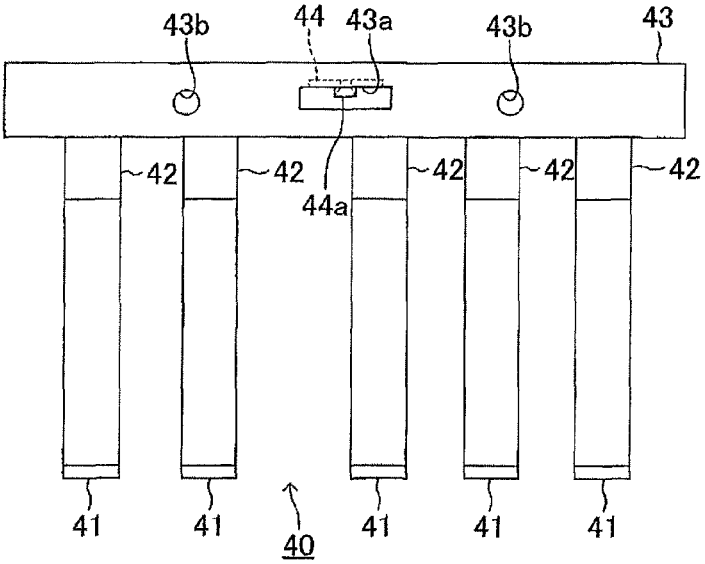
FIG. 8A is a plan view of the third key unit in FIGS. 1 through 4.
Figure 8C:
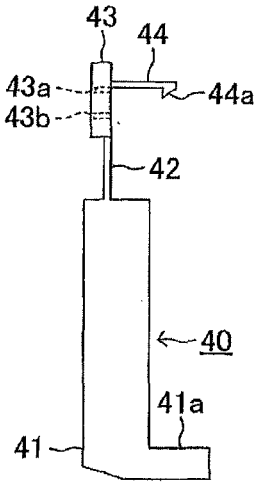
FIG. 8C is a side view of the third key unit.
Figure 8B:
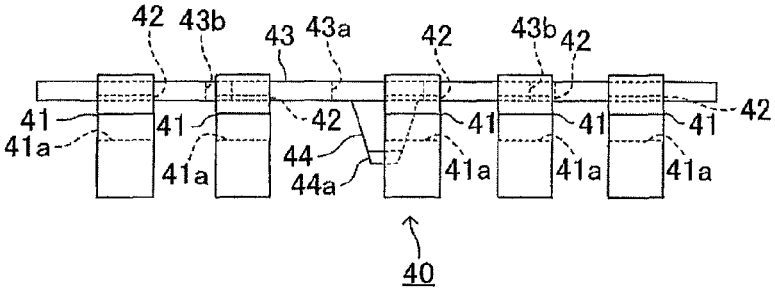
FIG. 8B is a front elevational view of the third key unit.

There will be next explained the third key unit 40 with reference to FIGS. 8A-8C. FIG. 8A is a plan view of the third key unit 40, FIG. 8B is a front elevational view thereof, and FIG. 8C is a side view thereof. The third key unit 40 includes five black keys 41 not next to each other and respectively corresponding to notes C#, D#, F#, G#, and A#. Each of the black keys 41 is also constituted by an upper plate, a front wall, side walls, and a rear wall, which define a space opening downward and having a rectangular shape in cross section. The length of the black key 41 in the front and rear direction is shorter than that of each of the white keys 21, 31 in the front and rear direction, and the height of the black key 41 is higher than that of each of the white keys 21, 31. The front wall of the black key 41 is inclined such that its lower portion is located in front of its upper portion. A lower surface of the white key 41 is provided with a protrusion 41*a* having the same shape and function as those of each of the protrusions 21*a*, 31*a* provided on the respective white keys 21, 31. However, this protrusion 41*a* is provided slightly at a rear of the protrusions 21*a*, 31*a* provided on the respective white keys 21, 31.

The rear walls of the respective five black keys 41 are connected to a coupler 43 via respective hinges 42. Each of the hinges 42 and the coupler 43 are similar in construction to the hinges 22, 32 and the couplers 23, 33, respectively. The coupler 43 has a through hole 43*a* having a rectangular parallelepiped shape. The through hole 43*a* extends through the coupler 43 in the up and down direction such that front and rear inner surfaces of the through hole 43*a* are parallel to respective front and rear surfaces of the coupler 43. Also, the coupler 43 has through holes 43*b* similar to the through holes 23*b*. The thickness of the hinge 42 in the up and down direction is equal to that of the hinges 22, 32. Likewise, the thickness of the coupler 43 in the up and down direction is equal to that of the couplers 23, 33. In the case of this construction, a lower surface of the hinge 42 is located above the lower surface of the black key 41, and an upper surface of the hinge 42 is located slightly below an upper surface of the black key 41. A lower surface of the coupler 43 is located above the lower surface of the black key 41 and at a height equal to that of the lower surface of the hinge 42. An upper surface of the coupler 43 is located slightly below the upper surface of the black key 41 and above the upper surface of the hinge 42. It is noted that dimensions of the through hole 43*a* and a vertical position of the third key unit 40 assembled to the key frame 10 will be described later in detail.

The lower surface of the coupler 43 is provided with a hook 44 that extends downward from a position which is a center of the coupler 43 in the right and left direction and which is located in front of a rear end surface of the coupler 43 and at the rear of the through hole 43*a*. The hook 44 extends downward through the through hole 33*a* of the second key unit 30, the through hole 23*a* of the first key unit 20, and the through hole 13*a* of the key frame 10 to assemble the first through third key units 20, 30, 40 to the key frame 10. The hook 44 has a rectangular shape elongated in the right and left direction in transverse section. A distance between right and left surfaces of the hook 44 decreases from its upper portion toward its lower portion. Also, the hook 44 has a trapezoid shape in front view. A front surface of the hook 44 and the rear inner surface of the through hole 43*a* are located on the same vertical plane. It is noted that the front surface of the hook 44 and the rear inner surface of the through hole 43*a* may not be located on the same vertical plane. The front surface of the hook 44 and the rear inner surface of the through hole 43*a* may be located on the same plane (different from vertical plane). The hook 44 has a small thickness in the front and rear direction so as to be elastically deformable in the front and rear direction, so that a lower end of the hook 44 is movable in the front and rear direction.

A lower end portion of the front surface of the hook 44 has an engaging portion 44*a*, in the form of an overhang, extending frontward and having a triangle shape in elevational cross section. In the state in which the hook 44 extends downward through the through hole 33*a* of the second key unit 30, the through hole 23*a* of the first key unit 20, and the through hole 13*a* of the key frame 10, the engaging portion 44*a* is engaged with a lower surface of the upper board 13 of the key frame 10 to assemble the first through third key units 20, 30, 40 to the key frame 10. The length from the lower surface of the coupler 43 to an upper surface of the engaging portion 44*a* is equal to the sum of the thickness of the upper board 13 of the key frame 10, the thickness of the coupler 23 of the first key unit 20, and the thickness of the coupler 33 of the second key unit 30. A portion of the engaging portion 44*a* which is located in front of the front surface of the hook 44 has a flat and horizontal upper surface. The length of the engaging portion 44*a* in the front and rear direction is less than the length of the through hole 43*a* in the front and rear direction. That is, the engaging portion 44*a* is opposed to a portion of the through hole 43*a* in the up and down direction. In other words, the upper surface of the engaging portion 44*a* is located in front of the rear inner surface of the through hole 43*a* in the front and rear direction, and the upper surface of the engaging portion 44*a* is opposed to the through hole 43*a* in the up and down direction. It is noted that dimensions of the engaging portion 44*a* will be described later in detail.

Figure 9:
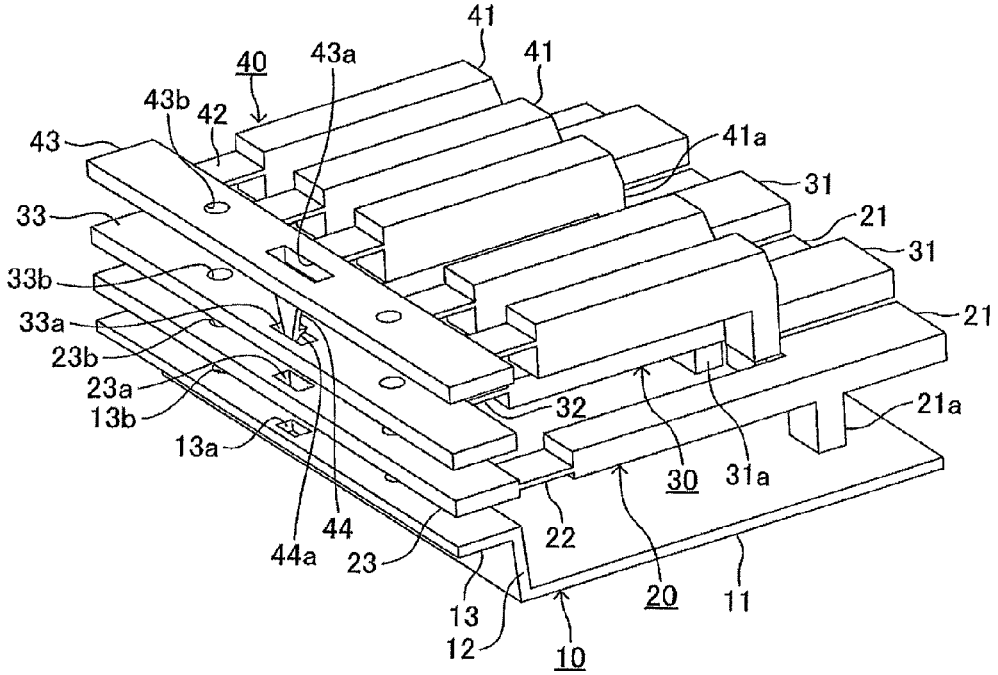
FIG. 9 is an exploded perspective view of the keyboard device for explaining assembly of the first through third key units to the key frame.

There will be next explained, with reference to FIGS. 1-5 and 9, steps for assembling the first through third key units 20, 30, 40 to the key frame 10 and an overall construction of the keyboard device after the assembly. In the assembly of the first through third key units 20, 30, 40 to the key frame 10, as illustrated in FIG. 9, the coupler 23 of the first key unit 20, the coupler 33 of the second key unit 30, and the coupler 43 of the third key unit 40 are sequentially stacked on the upper board 13 of the key frame 10 with alignment in the front and rear direction and the right and left direction. When the coupler 43 of the third key unit 40 is placed on the coupler 33 of the second key unit 30, the hook 44 is inserted downward into the through hole 33*a* of the second key unit 30, the through hole 23*a* of the first key unit 20, and the through hole 13*a* of the key frame 10. During this downward insertion, the lower portion of the hook 44 is inserted downward while being deformed rearward.

When the hook 44 is inserted further downward, a protrusion of a front end of the engaging portion 44*a* of the hook 44 is moved to a front lower side of the front lower end of the through hole 13*a* of the key frame 10, so that the upper surface of the engaging portion 44*a* is engaged with a lower surface of a portion of the upper board 13 which is located near a front end portion of the through hole 13*a*. This state is a state in which the first through third key units 20, 30, 40 are assembled to the key frame 10 (noted that this state may be hereinafter referred to as "assembled state"), and the first through third key units 20, 30, 40 are secured to the key frame 10. In this assembled state, as illustrated in FIG. 4 in particular, the lower surface of the coupler 23 of the first key unit 20 is held in contact with an upper surface of the upper board 13 of the key frame 10, the lower surface of the coupler 33 of the second key unit 30 is held in contact with the upper surface of the coupler 23 of the first key unit 20, and the lower surface of the coupler 43 of the third key unit 40 is held in contact with the upper surface of the coupler 33 of the second key unit 30. Since the positions of the hinges 22, 32, 42 and the couplers 23, 33, 43 of the first through third key units 20, 30, 40 are set in the up and down direction as described above, the white keys 21, 31, the black keys 41, and the hinges 22, 32, 42 are kept horizontal, and the upper surfaces of the respective white keys 21, 31 are located at the same height, while the upper surfaces of the respective black keys 41 are located above the upper surfaces of the respective white keys 21, 31.

Dimensions of the through hole 13*a* of the key frame 10, the through hole 23*a* of the first key unit 20, the through hole 33*a* of the second key unit 30, and the hook 44 of the third key unit 40 will be explained in detail. In particular, as illustrated in FIG. 5, the through hole 13*a*, the through hole 23*a*, and the through hole 33*a* have the same length in the front and rear direction, and the through hole 13*a* is located at a rear of the through hole 23*a* by a particular distance, and the through hole 23*a* is located at a rear of the through hole 33*a* by the particular distance. It is noted that the through hole 23*a* and the through hole 33*a* may not have the same length in the front and rear direction. The length of the protrusion of the engaging portion 44*a* which extends frontward from the front surface of the portion of the hook 44 which extends downward, i.e., from the rear surface of the through hole 43*a* is about three times longer than the particular distance as an amount of displacement of the through holes 13*a*, 23*a*, 33*a* in the front and rear direction, the front end of the engaging portion 44*a* is located substantially at the same position as the front surface of the through hole 33*a* in the front and rear direction. Thus, the front surface of the portion of the hook 44 which extends downward is spaced apart from the front surface of the through hole 13*a* by the particular distance, from the front surface of the through hole 23*a* by twice the particular distance, and from the front surface of the through hole 33*a* by three times the particular distance. The upper surface of the engaging portion 44*a* is held in contact with the lower surface of the portion of the upper board 13 which is located in front of the through hole 13*a*, over a distance that is twice the particular distance in the front and rear direction. In other words, as illustrated in FIG. 4, the through hole 13*a* is formed at a particular position of the upper board 13 of the key frame 10 such that when the rear end of the coupler 43 and the rear end of the upper board 13 of the key frame 10 are located at the same position in the front and rear direction, the front end of the engaging portion 44*a* is located in front of the front surface of the through hole 13*a* by twice the particular distance. It is noted that the distance between the front surface of the hook 44 and each of the through holes 13*a*, 23*a*, 33*a* and the length of the contact between the upper surface of the engaging portion 44*a* and the lower surface of the upper board 13 are not limited to the above-described examples and may be changed as needed.

As illustrated in FIG. 3 in particular, the centers of the through hole 13*a*, the through hole 23*a*, and the through hole 33*a* are located at the same position in the right and left direction, and the through hole 33*a* is greater than the through hole 23*a* in width in the right and left direction by the particular distance, while the through hole 23*a* is greater than the through hole 13*a* in width in the right and left direction by the particular distance. The center position of the through hole 43*a* of the third key unit 40 in the right and left direction is the same as the center position of each of the through hole 13*a*, the through hole 23*a*, and the through hole 33*a* in the right and left direction, but the width of the through hole 43*a* in the right and left direction is greater than the width of the through hole 33*a* in the right and left direction. The portion of the hook 44 which extends downward and of which front surface is located at the same position as the rear surface of the through hole 43*a* is symmetrical in the right and left direction with respect to the center of the through holes 13*a*, 23*a*, 33*a*, 43*a* in the right and left direction. The right and left surfaces of the hook 44 are inclined such that the width of the upper end of the hook 44 in the right and left direction is slightly less than that of the through hole 33*a*, and the width of the lower end of the hook 44 in the right and left direction is less than the through hole 13*a*, whereby the hook 44 has the trapezoid shape in front view as described above. In the width of the hook 44 in the right and left direction which decreases in the downward direction, the largest width of the hook 44 at a position opposed to the through hole 33*a* (i.e., at a position at which the hook 44 is inserted in the through hole 33*a*) is less than the width of the through hole 33*a* in the right and left direction, the largest width of the hook 44 at a position opposed to the through hole 23*a* (i.e., at a position at which the hook 44 is inserted in the through hole 23*a*) is less than the width of the through hole 23*a* in the right and left direction, and the largest width of the hook 44 at a position opposed to the through hole 13*a* (i.e., at a position at which the hook 44 is inserted in the through hole 13*a*) is less than the width of the through hole 13*a* in the right and left direction. Each of these largest widths is preferably set at a value near the width of a corresponding one of the through holes 33*a*, 23*a*, 13*a* in the right and left direction.

Accordingly, the hook 44 can be inserted into the through holes 33*a*, 23*a*, 13*a* from the upper side thereof such that the hook 44 extends through the through holes 33*a*, 23*a*, 13*a*. Also, during this insertion, the hook 44 cooperates with the through holes 33*a*, 23*a*, 13*a* to function as a guide. This facilitates the assembly of the third key unit 40 to the key frame 10 and increases accuracy of positioning of the first through third key units 20, 30, 40 to the key frame 10 in the right and left direction. In particular, the accuracy of positioning increases with decrease in difference between each of the largest widths and the width of the corresponding one of the through holes 33*a*, 23*a*, 13*a* in the right and left direction.

After the first through third key units 20, 30, 40 are assembled to the key frame 10 in the above-described manner, a fastening screw, not shown, is inserted, through each set of the respective through holes 43*b*, 33*b*, 23*b* formed in the couplers 43, 33, 23 of the third key unit 40, the second key unit 30, and the first key unit 20, from an upper side of the through hole 43*b* in the order of the through holes 43*b*, 33*b*, 23*b* and then engaged with a corresponding one of the screw holes 13*b* formed in the upper board 13 of the key frame 10. As a result, the first through third key units 20, 30, 40 are secured to the key frame 10, so that the keyboard device is finished.

In the embodiment as described above, the first through third key units 20, 30, 40 are assembled to the key frame 10 only by engaging the engaging portion 44*a* of the hook 44 with the lower surface of the upper board 13 after inserting the hook 44 provided on the coupler 43 of the third key unit 40, through the through holes 33*a*, 23*a* of the couplers 33, 23 of the respective second and first key units 30, 20 and the through hole 13*a* of the upper board 13 of the key frame 10 from an upper side of the through hole 33*a*. In the above-described embodiment, accordingly, the first through third key units 20, 30, 40 can be easily assembled to the key frame 10. Also, the hook 44 for assembling the first through third key units 20, 30, 40 to the key frame 10 fits within the length of the coupler 43 in the front and rear direction. This construction can reduce the width of the rear end portion of each of the first through third key units 20, 30, 40, leading to reduction in the dimension of each of the first through third key units 20, 30, 40 in the front and rear direction. In the above-described embodiment, accordingly, the manufacturing cost of the first through third key units 20, 30, 40 can be reduced, and a space formed by reducing the dimension of each of the first through third key units 20, 30, 40 in the front and rear direction can be effectively used for the other construction and components of the keyboard device.

In the above-described embodiment, the coupler 43 of the third key unit 40 which is provided with the hook 44 has the through hole 43*a* that is opposed to the engaging portion 44*a* in the up and down direction. Accordingly, the third key unit 40 can be easily formed in one piece not by using a complicated mold but only by using a pair of upper and lower molds. Also, in the above-described embodiment, the right and left surfaces of the hook 44 are inclined such that the distance therebetween decreases in the downward direction, and each of the width of the through hole 33*a* of the coupler 33 of the second key unit 30 in the right and left direction, the width of the through hole 23*a* of the coupler 23 of the first key unit 20 in the right and left direction, and the width of the through hole 13*a* of the upper board 13 of the key frame 10 in the right and left direction is greater than the distance between the right and left surfaces of the hook 44 which are opposed to the through holes 33*a*, 23*a*, 13*a*, and the width of the through hole 33*a* is greater than the width of the through hole 23*a*, and the width of the through hole 23*a* is greater than the width of the through hole 13*a*. That is, the widths of the through holes 33*a*, 23*a*, 13*a* opposed to the side surfaces of the hook 44 are defined so as to decrease with decrease in distance between each hole and the end portion of the hook 44. Furthermore, the space between the side surface of the hook 44 and each of the through holes 33*a*, 23*a*, 13*a* is made as small as possible. With this construction, when assembling the first through third key units 20, 30, 40 to the key frame 10, the hook 44 serves as a guide, making it possible to easily and well assemble the first through third key units 20, 30, 40 to the key frame 10.

While the embodiment has been described above, it is to be understood that the disclosure is not limited to the details of the illustrated embodiment, but may be embodied with various changes and modifications, which may occur to those skilled in the art, without departing from the spirit and scope of the disclosure.

In the above-described embodiment, the hook 44 is provided behind the through hole 43*a* of the coupler 43 of the third key unit 40, and the engaging portion 44*a* extending frontward is provided on the lower end portion of the front surface of the hook 44. Furthermore, after the hook 44 is inserted through the through holes 33*a*, 23*a*, 13*a*, the engaging portion 44*a* is engaged with the lower surface of the upper board 13 of the key frame 10 at the position in front of the through hole 13*a*. Instead of this construction, the keyboard device may be constructed such that the hook 44 is provided in front of the through hole 43*a* of the coupler 43 of the third key unit 40, and the engaging portion 44*a* protruding rearward is provided on a lower end portion of a rear surface of the hook 44, and after the hook 44 is inserted through the through holes 33*a*, 23*a*, 13*a*, the engaging portion 44*a* is engaged with the lower surface of the upper board 13 of the key frame 10 behind the through hole 13*a*.

Specifically, as illustrated in FIG. 10 corresponding to FIG. 4, the lower surface of the coupler 43 of the third key unit 40 is provided with the hook 44 that extends downward from a position which is a center of the coupler 43 in the right and left direction and which is located at a rear of a front end surface of the coupler 43 and at the front of the through hole 43*a*. As in the above-described embodiment, the hook 44 extends downward through the through hole 33*a* of the second key unit 30, the through hole 23*a* of the first key unit 20, and the through hole 13*a* of the key frame 10. In this modification, a rear surface of the hook 44 and a front inner surface of the through hole 43*a* are located on the same vertical plane. It is noted that the rear surface of the hook 44 and the front inner surface of the through hole 43*a* may not be located on the same vertical plane. The rear surface of the hook 44 and the front inner surface of the through hole 43*a* may be located on the same plane (different from vertical plane). A lower end portion of the rear surface of the hook 44 has the engaging portion 44*a*, in the form of an overhang, extending rearward, having a flat upper surface, and having a triangle shape in elevational cross section. Also in this modification, the length of the engaging portion 44*a* in the front and rear direction is less than the length of the through hole 43*a* in the front and rear direction. That is, the engaging portion 44*a* is opposed to a portion of the through hole 43*a* in the up and down direction. In other words, the upper surface of the engaging portion 44*a* is located at a rear of the front inner surface of the through hole 43*a* in the front and rear direction, and the upper surface of the engaging portion 44*a* is opposed to the through hole 43*a* in the up and down direction. In this modification, the upper surface of the engaging portion 44*a* is engaged with the lower surface of the upper board 13 behind the through hole 13*a*, whereby the first through third key units 20, 30, 40 are assembled to the key frame 10.

Also in this modification, the upper board 13 of the key frame 10 and the couplers 23, 33, 43 of the respective first through third key units 20, 30, 40 have the respective through holes 13*a*, 23*a*, 33*a*, 43*a* each having the rectangular parallelepiped shape as in the above-described embodiment. In this modification, however, the through hole 13*a* is located in front of the through hole 23*a* by the particular distance, the through hole 23*a* is located in front of the through hole 33*a* by the particular distance, and the through hole 43*a* is located at a rear of the hook 44. The rear surface of the portion of the hook 44 which extends downward is spaced apart from the rear surface of the through hole 13*a* by the particular distance, from the rear surface of the through hole 23*a* by twice the particular distance, and from the rear surface of the through hole 33*a* by three times the particular distance. The upper surface of the engaging portion 44*a* is held in contact with the lower surface of the portion of the upper board 13 which is located at a rear of the through hole 13*a*, over a distance that is twice the particular distance in the front and rear direction. In other words, as illustrated in FIG. 10, the through hole 13*a* is formed at a particular position of the upper board 13 of the key frame 10 such that when the rear end of the coupler 43 and the rear end of the upper board 13 of the key frame 10 are located at the same position in the front and rear direction, the rear end of the engaging portion 44*a* is located at a rear of the rear surface of the through hole 13*a* by twice the particular distance. It is noted that the distance between the rear surface of the hook 44 and each of the through holes 13*a*, 23*a*, 33*a* and the length of the contact between the upper surface of the engaging portion 44*a* and the lower surface of the upper board 13 are not limited to the above-described examples and may be changed as needed. Since the other construction is the same as that in the above-described embodiment, the same reference numerals as used in the above-described embodiment are used to designate the corresponding elements of this modification, and an explanation of which is dispensed with.

In this modification, the engaging portion 44*a* extends in the direction opposite to the direction in the above-described embodiment, but the hook 44 having the engaging portion 44*a*, the upper board 13 having the through hole 13*a*, and the couplers 23, 33, 43 having the respective through holes 23*a*, 33*a*, 43*a* function as in the above-described embodiment. Accordingly, this modification can achieve the same effects as obtained in the above-described embodiment.

In the above-described embodiment and its modification, each of the through holes 13*a*, 23*a*, 33*a* formed respectively in the upper board 13 of the key frame 10 and the couplers 23, 33 of the respective first and second key units 20, 30 has the rectangular parallelepiped shape, and the front and rear inner surfaces and the right and left inner surfaces of the through holes 13*a*, 23*a*, 33*a* extend in the vertical direction. Instead of this construction, the front and rear inner surfaces and the right and left inner surfaces of each hole may be inclined inward so as to be inner at its lower portion than at its upper portion, such that the inside space of each of the through holes 13*a*, 23*a*, 33*a* tapers down toward a lower side thereof. In particular, in the case where the front and rear inner surfaces and the right and left inner surfaces of each of the through holes 33*a*, 23*a*, 13*a* are inclined inward so as to be inner at its lower portion than at its upper portion in the construction in which the through hole 33*a* is greater than the through hole 23*a* in width in the right and left direction, and the through hole 23*a* is greater than the through hole 13*a* in width in the right and left direction, the hook 44 can be more easily inserted into the through holes 33*a*, 23*a*, 13*a*, thereby improving the guide function of the hook 44 cooperating with the through holes 33*a*, 23*a*, 13*a*.

In the above-described embodiment, the front surface of the hook 44 and the front inner surfaces of the respective through holes 33*a*, 23*a*, 13*a* are slightly spaced apart from each other. In the above-described modification, the rear side surface of the hook 44 and the rear inner surfaces of the respective through holes 33*a*, 23*a*, 13*a* are slightly spaced apart from each other. However, these spaces may not be provided. That is, in the above-described embodiment, the front surface of the hook 44 and the front inner surfaces of the respective through holes 33*a*, 23*a*, 13*a* may be held in contact with each other. Also, in the above-described modification, the rear side surface of the hook 44 and the rear inner surfaces of the respective through holes 33*a*, 23*a*, 13*a* may be held in contact with each other.

In the above-described embodiment and the modification, the upper surface of the upper board 13 of the key frame 10, the upper and lower surfaces of the couplers 23, 33 of the respective first and second key units 20, 30, and the lower surface of the coupler 43 of the third key unit 40 are flat. Instead of this construction, in order to facilitate positioning of the couplers 23, 33, 43 of the respective first through third key units 20, 30, 40 on the upper board 13 of the key frame 10, recesses, cuttings, and/or protrusions for positioning may be formed in or on the upper surface of the upper board 13, the upper and lower surfaces of the couplers 23, 33, and the lower surface of the coupler 43.

In the above-described embodiment and the modification, the coupler 23 of the first key unit 20, the coupler 33 of the second key unit 30, and the coupler 43 of the third key unit 40 are placed on the upper board 13 of the key frame 10 in this order from a lower side. However, the order of placement of the couplers 23, 33, 43 may be any order. In this case, the vertical positions of the couplers 23, 33, 43 need to be made different from those in the case of the above-described embodiment and the modification according to the order of placement of the couplers 23, 33, 43. For example, the keyboard device may be constructed such that the height of the coupler 23 of the first key unit 20 and the height of the coupler 33 of the second key unit 30 are reversed from each other, and the coupler 33 of the second key unit 30, the coupler 23 of the first key unit 20, and the coupler 43 of the third key unit 40 are placed on the upper board 13 of the key frame 10 in this order from a lower side. In this case, the coupler 23 and the coupler 33 are respectively formed with through holes similar to the respective through holes 33*a*, 23*a*.

In the above-described embodiment and the modification, the hook 44 is provided on the uppermost coupler 43 of the third key unit 40. However, the keyboard device may be constructed such that a hook is provided on the middle second key unit 30, and the first through third key units 20, 30, 40 are assembled to the upper board 13 of the key frame 10.

Specifically, as illustrated in FIG. 11 corresponding to FIG. 4, the lower and upper surfaces of the coupler 33 of the second key unit 30 are respectively provided with a first hook 34 and a second hook 35 which respectively extend downward and upward from a position which is a center of the coupler 33 in the right and left direction and which is located in front of the rear end surface of the coupler 33 and at the rear of the through hole 33*a*. The first hook 34 extends downward through the through hole 23*a* of the first key unit 20 and the through hole 13*a* of the key frame 10. A lower end portion of a front surface of the first hook 34 is provided with a first engaging portion 34*a*, in the form of an overhang, extending frontward and having a triangle shape in elevational cross section with a flat upper surface. The second hook 35 extends upward through the through hole 43*a* of the third key unit 40. An upper end portion of a front surface of the second hook 35 is provided with a second engaging portion 35*a*, in the form of an overhang, extending frontward and having a triangle shape in elevational cross section with a flat lower surface. The front surfaces of the respective first and second hooks 34, 35 and the rear inner surface of the through hole 33*a* are located on the same vertical plane. Also in this modification, the front surfaces of the respective first and second hooks 34, 35 and the rear inner surface of the through hole 33*a* may not be located on the same vertical plane. The length of each of the first and second engaging portions 34*a*, 35*a* in the front and rear direction is less than the length of the through hole 33*a* in the front and rear direction. That is, each of the first and second engaging portions 34*a*, 35*a* is opposed to a portion of the through hole 33*a* in the up and down direction. In this modification, the upper surface of the first engaging portion 34*a* is engaged with the lower surface of the upper board 13 in front of the through hole 13*a*, whereby the second and third key units 30, 40 are assembled to the key frame 10. The lower surface of the second engaging portion 35*a* is engaged with the upper surface of the coupler 43 in front of the through hole 43*a*, whereby the third key unit 40 is assembled to the first and second key units 20, 30 and the key frame 10.

Also in this modification, the upper board 13 of the key frame 10 and the couplers 23, 33, 43 of the respective first through third key units 20, 30, 40 are respectively formed with the through holes 13*a*, 23*a*, 33*a*, 43*a* each having a rectangular parallelepiped shape. The through hole 13*a* is located at a rear of the through hole 23*a*, and the through hole 23*a* is located at a rear of the through hole 33*a*. The through hole 43*a* is located at a rear of the through hole 33*a*, and the through hole 33*a* is located in front of the first and second hooks 34, 35. A front surface of a portion of the hook 34 which extends downward is spaced apart from the front surface of the through hole 13*a* by a particular distance and from the front surface of the through hole 23*a* by a distance which is greater than the particular distance. A front surface of a portion of the second hook 35 which extends downward is spaced apart from the front surface of the through hole 43*a* by a particular distance. The upper surface of the first engaging portion 34*a* is held in contact with a lower surface of a portion of the upper board 13 which is located in front of the through hole 13*a*, over the particular distance in the front and rear direction. The lower surface of the second engaging portion 35*a* is held in contact with an upper surface of a portion of the coupler 43 which is located in front of the through hole 43*a*, over the particular distance in the front and rear direction.

Also in this modification, right and left surfaces of the first hook 34 are inclined such that a distance therebetween decreases toward a distal end of the first hook 34, and each of the width of the through hole 23*a* of the coupler 23 of the first key unit 20 in the right and left direction and the width of the through hole 13*a* of the upper board 13 of the key frame 10 in the right and left direction is greater than the largest width, in the right and left direction, of a portion of the first hook 34 which is opposed to the through holes 23*a*, 13*a*, and the width of the through hole 23*a* is greater than the width of the through hole 13*a*. That is, the widths of the through holes 23*a*, 13*a* opposed to a side surface of the first hook 34 are defined so as to decrease with decrease in distance between each hole and the end portion of the first hook 34. Furthermore, a space between the side surface of the first hook 34 and each of the through holes 23*a*, 13*a* is made as small as possible. Also, right and left surfaces of the second hook 35 are inclined such that a distance therebetween decreases toward a distal end of the second hook 35, and the width of the through hole 43*a* of the coupler 43 of the third key unit 40 in the right and left direction is greater than the largest width, in the right and left direction, of a portion of the second hook 35 which is opposed to the through hole 43*a*. Since the other construction is the same as that in the above-described embodiment, the same reference numerals as used in the above-described embodiment are used to designate the corresponding elements of this modification, and an explanation of which is dispensed with.

In this modification, after the first hook 34 is inserted through the through holes 23*a*, 13*a* in this order, the first engaging portion 34*a* is engaged with the lower surface of the upper board 13 to secure the first and second key units 20, 30 onto the upper board 13. Then, after the second hook 35 is inserted through the through hole 43*a*, the second engaging portion 35*a* is engaged with the upper surface of the coupler 43 to secure the third key unit 40 onto the second key unit 30. The first and second hooks 34, 35 having the respective first and second engaging portions 34*a*, 35*a*, the upper board 13 having the through hole 13*a*, and the couplers 23, 43 having the respective through holes 23*a*, 43*a* function as in the above-described embodiment. Accordingly, this modification can achieve the same effects as obtained in the above-described embodiment.

The second key unit 30 is provided with the first and second hooks 34, 35 in this modification. Instead of this construction, the first key unit 20 may be provided with first and second hooks having respective first and second engaging portions as in the above-described modification. In this case, the first hook extends downward through the through hole 13*a* of the key frame 10, and the first engaging portion is engaged with the lower surface of the upper board 13. The second hook extends upward through the through holes 33*a*, 43*a* of the respective second and third key units 30, 40, and the second engaging portion is engaged with the upper surface of the coupler 43.

Also, as in the modification of the above-described embodiment (see FIG. 10), the first and second hooks 34, 35 may be provided in front of the through hole 33*a* of the coupler 33 of the second key unit 30, and first and second hooks similar to the first and second hooks 34, 35 may be provided in front of the through hole 23*a* of the coupler 23 of the first key unit 20. The shapes and sizes of the through holes 13*a*, 23*a*, 33*a* which have been explained as a modification of the above-described embodiment also apply to this modification. Also in this modification, the order of placement of the coupler 23 of the first key unit 20, the coupler 33 of the second key unit 30, and the coupler 43 of the third key unit 40 on the upper board 13 of the key frame 10 may be any order.

What is claimed is:

1. A keyboard device, comprising:

a plurality of key units each comprising (i) a plurality of white keys or a plurality of black keys and (ii) a coupler elongated so as to extend in a key arrangement direction in which the plurality of white keys or the plurality of black keys are arranged, rear ends of the plurality of white keys or the plurality of black keys being coupled to the coupler, the plurality of white keys or the plurality of black keys and the coupler being coupled in one unit; and a key frame supporting a plurality of couplers of the plurality of key units, the plurality of couplers being stacked on each other, the plurality of key units being assembled to the key frame, the coupler of one key unit of the plurality of key units being provided with a hook extending in an up and down direction, the hook comprising an engaging portion at an end portion of the hook, the hook being configured to fit within a length of the coupler of the one key unit, the plurality of key units comprising at least one other key unit other than the one key unit, the coupler of each of the at least one other key unit comprising a through hole formed through the coupler in the up and down direction at a position corresponding to the hook, the key frame comprising a through hole formed through the key frame in the up and down direction at a position corresponding to the hook, the plurality of couplers of the plurality of key units being secured on the key frame using the engaging portion in a state in which the hook extends through the through hole of the coupler of each of the at least one other key unit and the through hole of the key frame.

2. The keyboard device according to claim 1, wherein the coupler of the one key unit is located on an uppermost position among the plurality of couplers in a state in which the plurality of key units are assembled to the key frame, wherein the hook protrudes downward from a lower surface of the coupler of the one key unit, wherein the engaging portion protrudes in a horizontal direction at a lower end portion of the hook, and wherein the hook extends downward through the through hole of the coupler of each of the at least one other key unit and the through hole of the key frame, and the engaging portion is engaged with a lower surface of the key frame.

3. The keyboard device according to claim 1, wherein the coupler of the one key unit is located on a lower side of an uppermost one of the plurality of couplers in a state in which the plurality of key units are assembled to the key frame, wherein the hook comprises:

a first hook protruding downward from a lower surface of the coupler of the one key unit and comprising a first engaging portion protruding in a horizontal direction at a lower end portion of the first hook; and a second hook protruding upward from an upper surface of the coupler of the one key unit and comprising a second engaging portion protruding in the horizontal direction at an upper end portion of the second hook, wherein the first hook extends downward through the through hole of the key frame or extends downward through the through hole of the coupler of the at least one other key unit which is located under the coupler of the one key unit and through the through hole of the key frame, and the first engaging portion is engaged with a lower surface of the key frame, and wherein the second hook extends upward through the through hole of the coupler of the at least one other key unit which is located over the coupler of the one key unit, and the second engaging portion is engaged with an upper surface of the coupler located on an uppermost position among the plurality of couplers.

4. The keyboard device according to claim 1, wherein the coupler of the one key unit comprises a through hole opposed to the engaging portion in the up and down direction.

5. The keyboard device according to claim 1, wherein a side surface of the hook is inclined such that a length of the hook decreases toward the end portion, wherein a length of a portion of the through hole of the coupler of each of the at least one other key unit, which portion is opposed to the side surface of the hook, is greater than a length of a side surface of a portion of the hook, which portion is opposed to the through hole of the coupler of said each of the at least one other key unit, wherein a length of a portion of the through hole of the key frame, which portion is opposed to the side surface of the hook, is greater than a length of a side surface of a portion of the hook, which portion is opposed to the through hole of the key frame, and wherein a length of portions of (i) the through hole of the coupler of each of the at least one other key unit and (ii) the through hole of the key frame, which portions are opposed to the side surface of the hook, decreases toward the end portion of the hook.

6. The keyboard device according to claim 1, wherein the hook is configured to fit within the length of the coupler of the one key unit in a front and rear direction perpendicular to the key arrangement direction.

7. The keyboard device according to claim 1, wherein the coupler of the one key unit comprises a through hole extending through the coupler from an upper surface to a lower surface thereof.

8. The keyboard device according to claim 7, wherein a front or rear surface of the hook and an inner surface of the through hole are located on an identical plane.

9. The keyboard device according to claim 8, wherein the front surface of the hook and a rear inner surface of the through hole are located on an identical plane.

10. The keyboard device according to claim 9, wherein the engaging portion extends frontward from the front surface of the hook.

11. The keyboard device according to claim 8, wherein the rear surface of the hook and a front inner surface of the through hole are located on an identical plane.

12. The keyboard device according to claim 11, wherein the engaging portion extends rearward from the rear surface of the hook.

* * * * *